US005083416A

United States Patent [19]

Schneider et al.

[11] Patent Number: 5,083,416

[45] Date of Patent: Jan. 28, 1992

[54] METHOD AND APPARATUS FOR INTRODUCING A SLIDING LID OR SEAL INTO A TUBULAR CYLINDRICAL BODY

[75] Inventors: Bernard Schneider; Roland Florini, both of Sainte-Ménéhould, France

[73] Assignee: Cebal, Clichy, France

[21] Appl. No.: 551,854

[22] Filed: Jul. 13, 1990

[30] Foreign Application Priority Data

Jul. 19, 1989 [FR] France ..... 89 10379

[51] Int. Cl.[5] ..... B65B 7/28

[52] U.S. Cl. ..... 53/489; 53/321

[58] Field of Search ..... 53/489, 320, 321, 488, 53/470

[56] References Cited

U.S. PATENT DOCUMENTS

| | | | |
|---|---|---|---|
| 2,665,832 | 1/1954 | Bagby | 53/321 X |
| 2,717,730 | 9/1955 | Blann | 53/321 X |
| 2,849,848 | 9/1958 | Ravn | 53/321 |
| 2,903,832 | 9/1959 | Graff | 53/320 |
| 3,270,483 | 9/1966 | Smoyer | 53/320 |
| 4,809,887 | 3/1989 | Jopin | 53/489 X |
| 4,819,936 | 4/1989 | Meckenstock | 53/489 X |
| 4,864,799 | 9/1989 | Colacicco | 53/320 |

FOREIGN PATENT DOCUMENTS

| | | | |
|---|---|---|---|
| 3614 | 7/1878 | Fed. Rep. of Germany | 52/320 |

*Primary Examiner*—John Sipos

*Attorney, Agent, or Firm*—Dennison, Meserole, Pollack & Scheiner

[57] ABSTRACT

The invention discloses a method of and apparatus for inserting a lid, or plug closure, in a container body by use of a thrust member bearing on the back surface of the lid in which the thrust member is applied in such a way as to obtain a creasing of the lid when the pressure of the air trapped in the said body increases, this air then escaping between the lid and the container body. The invention is applicable to the fields of cosmetics, pharmaceuticals, hygiene products and foodstuffs.

10 Claims, 3 Drawing Sheets

METHOD AND APPARATUS FOR INTRODUCING A SLIDING LID OR SEAL INTO A TUBULAR CYLINDRICAL BODY

BACKGROUND OF THE INVENTION

The present invention relates to a method of evacuating the air when introducing into a sealing-tight tubular body, for example the rigid or semi-rigid body of a receptacle or a distributor, of a lid or seal adapted to slide therein in sealing-tight manner.

The document FR-B-2605983=EP-A-270467=U.S. Pat. No. 4,809,887 describes a method of introducing a sliding piston into a body of a distributor filled with pasty product, in which the sealing-tight lip situated at the front of the piston is contracted by passing through an inlet zone flared according to a transverse relief of minimal diameter which is 0.3 to 1.5 mm smaller than the inside diameter of the said body. This contraction of the lip creates tiny undulations or curling through which the air trapped between the piston and the pasty product can escape and it is necessary that the piston move forward at a speed of at least 40 mm/s for these undulations to persist under the effect of the passage of air.

When the speed of the piston diminishes, the small undulations disappear and the air no longer passes through, so that in practice a small amount of air is occluded, corresponding to the slowing down and stoppage of the piston. Furthermore, the solution of an inner transverse relief is applied above all to tubular bodies of synthetic plastics material and the creation of such a relief by means of an attached foot, although it may well suit other kinds of bodies, is a complication with regard to storage and the series production of distributors.

The Applicants have sought to perfect a solution which avoids such drawbacks.

SUMMARY OF THE INVENTION

As its first object, the invention relates to a method of introducing a sealing-tightly sliding lid or seal into a tubular cylindrical body by using thrust means which bear on the back face of the lid characterised in that the said thrust means are applied to the said back face in such a way as to obtain a folding of the said lid when the pressure of the air trapped in the said body increases, this trapped air then escaping between the lid and the body.

The solution thus perfected is particularly simple. It has been noted that for a lid such as the front face of a sliding piston introduced into the tubular cylindrical body which has a closed bottom or which is filled with a product, the forward movement of the lid having only a portion of its back side pressed upon, did, for a certain forward movement of this lid produce an escape of air between its periphery and the tubular body. If one then stops and continues introduction of the piston, the escape of air will again occur but for a lesser forward movement of the lid. A more or less pronounced deformation of the lid occurs when the pressure of the trapped air increases, this deformation giving rise to localised separation or changes in the bearing of the sealing-tight means between the inside wall of the tubular body, allowing the trapped air to pass. The pressure of the occluded air is the factor which triggers this mechanism and which therefore permits of a complete or almost complete purging of the air through successive air passages which become increasingly closer to one another when the lid approaches the bottom or the product contained, whatever may be the speed of insertion of the lid. The bearing pressure of the back side of the lid must be such that it is capable of producing a folding or a flexing of this lid under the effect of the pressure of the trapped air which is exerted on the front face.

The method can be applied to any sealing-tightly sliding lid or plug, such plug being transverse in relation to the tubular cylindrical body into which it is pushed. It is applied particularly to a sliding piston of which the sealing-tight sliding means consist of a flexible flared peripheral lip which, in the free state, has an overall diameter greater than the diameter of the tubular body, this difference in diameter permitting of a slight forcing effect and the sealing-tight bearing surface of the peripheral lip being typically 0.2 to 0.8 mm high, while the front face of the piston constituting the lid is typically of synthetic plastics material and is of a thickness comprised between 0.6 and 1.4 mm.

This lid is lightweight and can be deformed under the pressure exerted on its front side by the trapped air. The bearing area of the thrust means on the back side of the lid, usually via a push-member or tip, comprises, at the moment of a deformation which allows the trapped air to pass, both initial bearing zones, with no back-pressure from this air, and supplementary bearing zones which are often an extension of the former and which have as their main characteristic feature that of being initially disposed at least 1.5 mm from the back side.

In accordance with frequent configurations, these supplementary bearing zones correspond to surfaces having a radius of curvature of 8 mm or more on the push-member, surfaces which extend the initial bearing surfaces of the push-member on the said back side of the lid A more precise definition of the bearing area may use zones at an initial distance of less than 1 mm instead of 1.5 mm.

As the bearing area of the push means is defined in such a way as to fix the rules relating to the efficacy of this bearing, it is noted that this bearing area comprises one or a plurality of continuous or intermittent bearing zones and provides a rigid support for the back side of the lid of which the elongated edges favour the bending or folding of this lid.

The preferred configurations of this bearing area are as follows:

in the event of the lid for example the front face of a sliding piston, being circular, the bearing area of the thrust means of the cap has an overall length at least equal to 0.6 and preferably 0.7 times the overall diameter of the lid and an overall width at most equal to 0.5 and preferably between 0.1 times and 0.4 times the said overall diameter;

in the particular case where the lid comprises a central hollow opening out onto its front face, this hollow serving for example to accommodate a pump of a distributor when the cap is at the end of its stroke, the bearing area of the thrust means comprises bearing zones situated on either side of the central hollow and in order further to facilitate folding of the cap, the said bearing area does not extend transversely beyond the central hollow. The back side of the lid may comprise inclined parts or cranked portions, the push-member having an appropriate front face and the preceding rules being understood as a projection onto a plane at right-angles to the axis through the system.

In practice, this method can be carried out at different insertion speeds but if the speed is high, for example more than 40 to 80 mm/s as is normal in packaging plants, jolts are observed which correspond to the triggering of an air escape every time the corresponding pressure of the occluded air or "critical escape pressure" is attained. Moreover, it is necessary to provide for a deceleration in order to stop at the desired distance and this is preferably achieved by pushing the product in order completely to eliminate the occluded air and then filling the compression chamber and ensuring or thus facilitating the priming of distribution.

In the case of a sliding piston, an alternative method has been perfected according to the invention: if the tubular body, typically that of a distributor, contains a liquid, creamy or pasty product, the lid being the front part of a sliding piston edged with a flexible flared peripheral lip, this lip is progressively reduced to a diameter less by at least 0.6 mm than the sliding diameter of the tubular body at the onset of insertion of the sliding piston, the thrust speed of the sliding piston then being greater than 40 mm/s in order to make sure that, at such a speed, the trapped air is evacuated from the onset of the said insertion, according to the principle disclosed in document EP-A-270467. Then, the total insertion time of the sliding piston is reduced, the new air leakage mechanism coming into action only when the speed has slowed to below 40 mm/s.

Preferably, the thrust speed is thus reduced to less than 30 mm/s with effect from 1 mm or more distance between the front face of the sliding piston and the product contained. This speed-limiting distance is advantageously 1 to 5 mm.

Again preferably, when the contained product is creamy or pasty, it is approached with a thrust speed of 10 to 30 mm/s and insertion of the piston is continued into the product until distribution is started, that is to say for instance until such time as the product fills the compression chamber of the distributor and passes through the expulsion valve. Thanks to the air evacuating mechanism according to the invention, this procedure ensures a very forced discharge of the air at the same time as a priming of the distribution means. In the event of the distributor which has a rigid or semi-rigid body being equipped with a distributing pump, and more particularly a pump with no return air facility, of a type known from documents EP-A-0143183 and EP-A-0251863, the product contained being a liquid or a fluid cream, the positioning of a sliding piston according to the invention makes it possible to reduce the volume of trapped air to a minimum, the trapped air escaping even when the piston is moving at a low speed.

After introduction of the piston, the protection of the rear of the piston is often carried out by means of an attached base. The Applicants have perfected an attached base which is particularly interesting by virtue of the ease with which it can be positioned: this base, of relatively flexible plastics material, for example PE, comprises a transversely deformable annular crease which is preferably clampingly fitted around the end of the tubular body, this base having in its central part an air hole, the part outside this crease being of less width, so that the base adapts itself equally well to slight ovality or variations in diameter of the end of the body and also to small amounts of offset of the fitment of this end in the said attached base.

A further object of the invention is the apparatus for introducing a sliding piston in sealing-tight manner into the interior of the tubular cylindrical body of a receptacle in the event of the front part of this piston being edged with a flexible flared peripheral lip which with a slight forcing action, is inserted into the tubular body of the receptacle. The characteristic features of this apparatus will become apparent from the ensuing description of the method and from the following Examples.

In addition to providing a simple solution to the difficulties, mentioned, the invention makes it possible to avoid any pollution inside the sliding piston.

DESCRIPTION OF THE PREFERRED EMBODIMENTS

EXAMPLE 1

Figure 1:
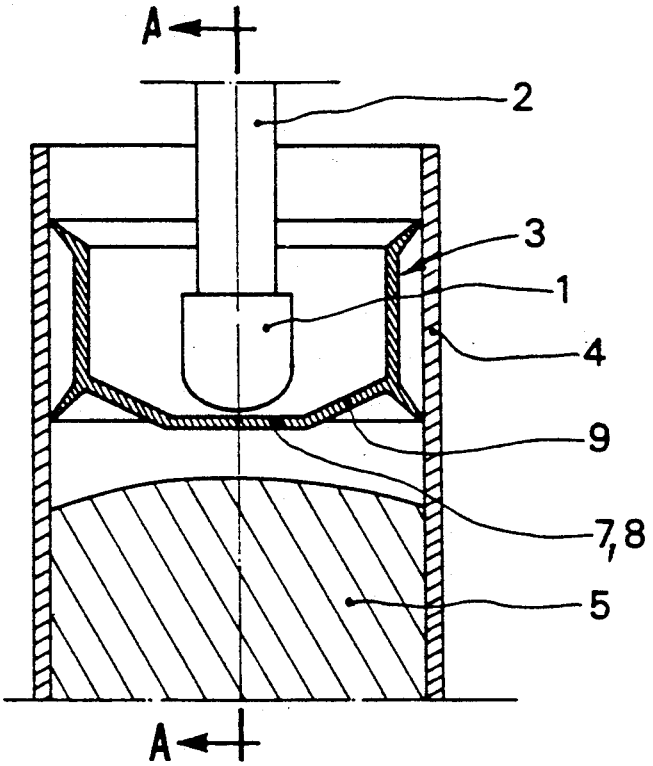
FIG. 1 shows in cross-section a sliding piston being inserted according to the invention into a tubular body filled with pasty product.
Figure 2:
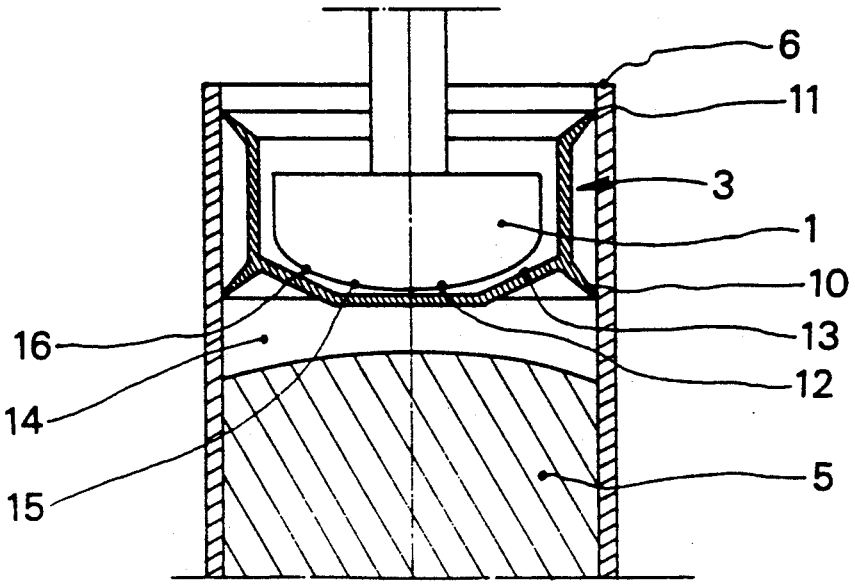
FIG. 2 shows, at an angle of 90° to FIG. 1 (section AA), the active end of the thrust means bearing on the back side of the front of the sliding piston.

FIGS. 1 and 2 show a push-member 1 of PA6 fixed to an insertion rod 2 pushing a 15 mm high sliding piston 3 into the interior of a tubular cylindrical body 4 with an inside diameter 52 mm and a thickness of 0.5 mm, of a distributor, the said body 4 being filled with pasty product 5 as far as 30 to 32 mm from the open bottom end 6 of the tubular body 4. For filling and in order to be closed by the piston 3, the distributor is in an inverted position, the open end 6 being at the top. The front shell 7 of the sliding piston 3 which is of PE-HD is 0.9 mm thick and on its back side it comprises a central flat portion 8 with a diameter of 25 mm surrounded by a frustoconical portion 9 at 15° to the flat portion 8 and extending as far as an inside diameter 48 mm, followed by a short cylindrical portion at the base of which is the slightly flared flexible peripheral sealing lip 10. This lip 10, of reduced thickness at its end, has an inside diameter of 51 mm at its base and an outside diameter at the tip or an overall diameter of 53.5 mm in the free state. The height between the end of the lip 10 and the end of the semi-rigid guide lip 11 at the rear of the sliding piston 3 is 13 mm. The push-member 1 is 44 mm long, according to the plane of FIG. 2 and 14 mm wide according to the plane in FIG. 1 at right-angle to the plane of FIG. 2, the connections between length and width being carried out to a radius of 7 mm. The initial bearing zone 12 of the push-member against the back side 13 of the shell 7 is 8×12 mm. When engagement of the sliding piston 3 is more pronounced, the pressure of the trapped air 14 increasing on its front face, the additional bearing zones will subsequently be obtained from the deformation of the front shell 7 corresponding to points such as 15 and 16 identified on the front surface of the push-member 1 (FIG. 2). The width of the bearing zone will vary by less than 1 mm by virtue of the small radii of curvature of the surfaces bordering the initial bearing zone of width 8 mm as seen in FIG. 1. The bearing area of the push-member, dynamically or effectively, is then about 8.5×40 mm while the diameter of the lid or front shell 7 of the piston 3 is 50 mm.

The push-member 1 has been introduced into the body 4 and stopped when its front was 46 mm lower than the open end 6 of the tubular body 4. It was noted that with effect from half way down this distance, air was expelled along the inner wall of the cylindrical body 4. Forward movement was then resumed at 15 mm/s, the sliding piston 3 stopping 8 mm lower down. It was observed that the pasty product had been delivered into the compression chamber of the distributor without any escape of this product around the edge of the piston 3 and that then emptying of the distributor did not produce any bubbles or irregularities which might be attributed to occluded air. The interpretation is as follows: the residual air is effectively expelled by the mechanism according to the invention even over a short distance and sealing-tightness in respect of the pasty product due to the peripheral lip 10 is then restored for delivery of this pasty product 5.

EXAMPLE 2

Figure 3:
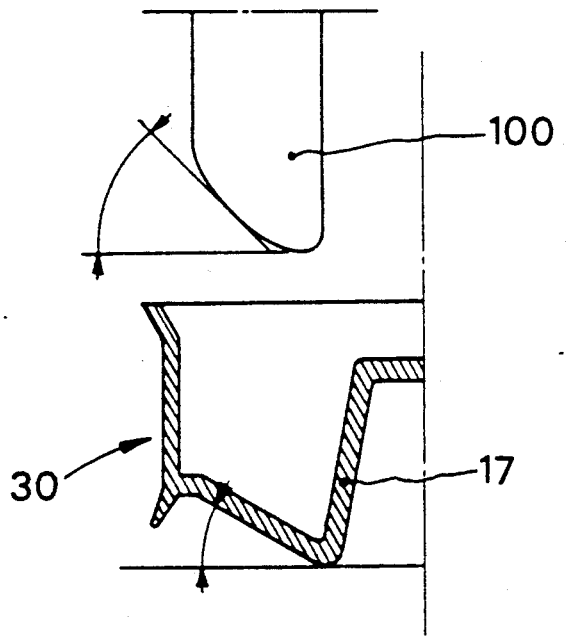
FIG. 3 shows a second thrust means on the point of being applied to the back side of the front face of a second sliding piston, this means comprising a central hollow in the form of a pit, in a semi cross-section.
Figure 4:
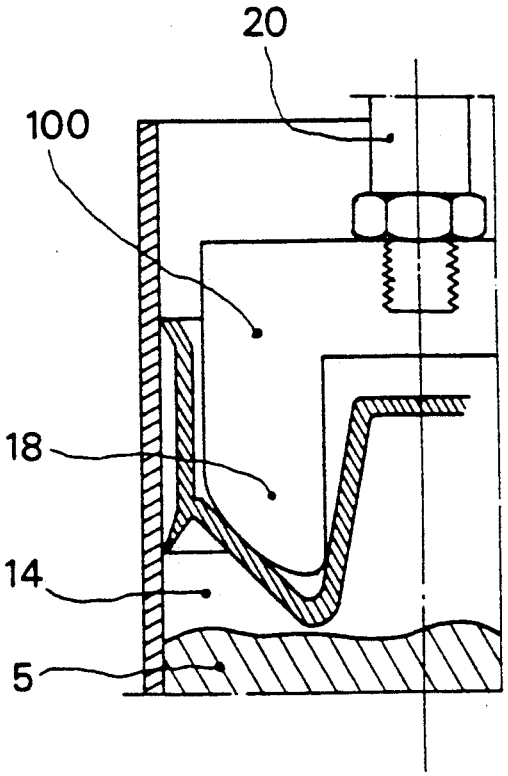
FIG. 4 shows the same thrust means bearing on the same back side with a deformation of this face.
Figure 5:
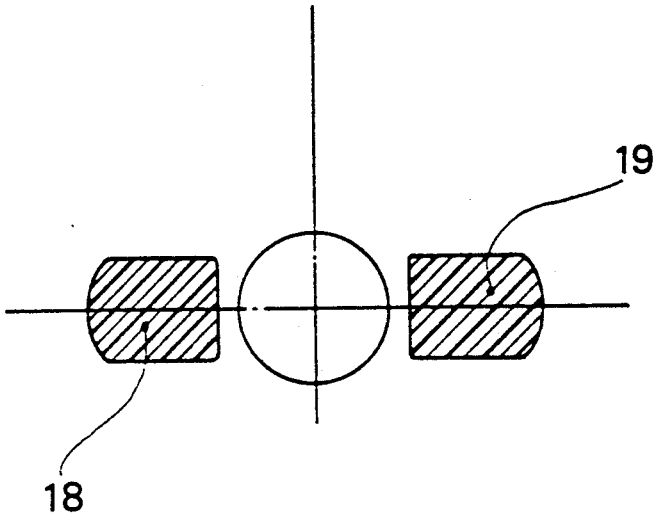
FIG. 5 is a cross-section through the same thrust means.

FIGS. 3 to 5 illustrate the implementation of the invention in the case of a sliding piston 30 comprising a central pit 17 with an inside diameter of 8 mm on its front face. The push-member 100 fixed to the insertion rod 20 has a U-shaped cross-section 8 mm wide and with an overall length of 48 mm, its two bearing arms 18 and 19 being 12 mm apart (see FIG. 5). FIG. 4 shows the push-member 100 bearing on the back face 21 of the piston 30 and deforming it due to the increase in pressure of the air 14 trapped between the piston 30 and the tubular body which has an inside diameter of 51 mm. This push-member 100, inserted at 20 mm/s and stopped in the heart of the pasty product provides as previously for satisfactory evacuation of the air trapped between the sliding piston 30 and the pasty product 5.

EXAMPLE 3

Figure 6:
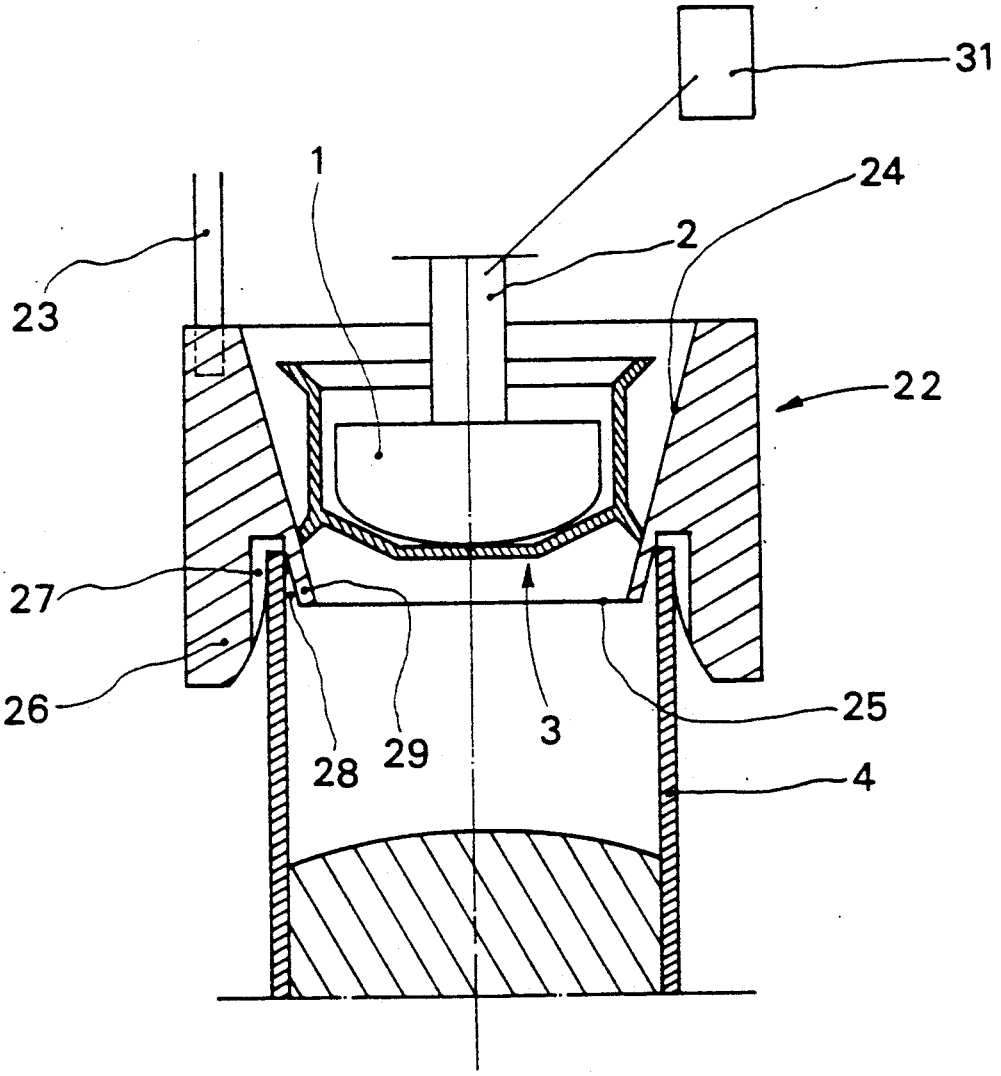
FIG. 6 shows a device according to the invention comprising an annular push member in cross-section.

FIG. 6 shows an insertion apparatus comprising an annular member 4 with an entrance 22 fixed to operating rods 23 which position it over the end of the distributor body, this member 22 comprising a frustoconical inner surface 24 the bottom end 25 of which has an inside diameter of 50.8 mm, centring being carried out by its outer skirt 26. Air passages 27 in the form of chambers which provide communication between the outside of the tubular body 4 and the intermediate space 28 comprise between the inner frustoconical shell 29 of the member 22 and the body 4 are provided around the circumference of this annular member 22.

This entry member 22 has been used for introducing sliding pistons 3 into bodies 4 as far as 1 to 2 mm from the pasty product, by pushing them with a circular push-member of 30 mm diameter at 60 mm/s and then an identical push-member to that in Example 1 was used, delivering the pasty product at 20 mm/s as far as 3 to 4 mm from its filling level. The use of distributors which are thus pre-primed has not given rise to any problems.

The two preceding phases of insertion may be carried out with one and the same push-member 1 according to the invention (FIG. 6) by means of an appropriate control 2 and 31.

APPLICATIONS

The invention is applied mainly to distributors of cosmetics, pharmaceutical, hygiene and food products.

We claim:

1. A method for sealing an open end of an otherwise closed tubular cylindrical body, comprising the steps of:
   inserting within said open end a sliding tight seal having a front face oriented toward said body, and a back face oriented away from said body; and
   bearing on said back face with a thrust means to cause said seal to slide within said open end in a direction toward said body, closing said body and decreasing the volume of said closed body, thus increasing the pressure of air trapped within said closed body;
   said thrust means bearing on said back face in a manner which is circumferentially non-symmetrical with respect to the seal and which produces on the seal a force substantially along an axis in the plane of the seal so as to cause a folding deformation of said sliding tubular seal along said axis as the pressure of the trapped air increases, said folding deformation allowing air to escape between said seal and said body.

2. A method according to claim 1, further comprising continuing said bearing to cause further sliding of said seal toward said body, together with successive cycles comprising increase in air pressure, folding deformation, and escape of air between said seal and said body.

3. A method according to claim 2 in which said body contains a product, and said sliding is continued until said seal contacts the product, producing a complete purging of air trapped in said body.

4. A method according to claim 1 in which said seal (7) is the front part of a sliding piston (3;30), the sealing-tight sliding means of said seal being constituted by a flexible flared peripheral lip (10) which in the free state has an overall diameter which is greater than the sliding diameter of said tubular body (4).

5. A method according to claim 4, in which said seal (7) is circular, the bearing area of said thrust means comprising initial bearing zones (12) which are applied to said back face and zones (15;16) which are initially less than 1.5 mm away from said back face (13), said bearing area having an overall length which is at least equal to 0.6 times the overall diameter of said seal (7) and an overall width which is at most equal to 0.5 times said overall diameter.

6. A method according to claim 5 in which said overall width of said bearing area is between 0.1 times and 0.4 times said overall diameter.

7. A method according to claim 6 in which said seal comprises a central hollow (17) which opens out onto said front face, said bearing area of the thrust means (100) comprising bearing zones situated on either side of said central hollow (17).

8. A method according to any one of claims 4 to 7, wherein the said tubular body (4) containing a liquid, creamy or pasty product (5) and said peripheral lip (10) being progressively reduced to a diameter which is at least 0.6 mm smaller than the sliding diameter of said tubular body (4) at the onset of insertion of the said sliding piston (23;30), the speed of thrust of the said piston being then greater than 40 mm/s in order to ensure the evacuation of trapped air (14) from the commencement of the said insertion.

9. A method according to claim 8 in which the speed of thrust is subsequently diminished to less than 30 mm/s with effect from a distance at least equal to 1 mm between said sliding piston (3;30) and the product (5) contained.

10. A method according to claim 9 in which the speed of thrust is between 10 and 30 mm/s at the approach to the contained product (5), said tubular body (4) belonging to a distributor of creamy or pasty product and having distribution means, insertion of the piston (3;30) being continued into the said product in order to prime distribution.

* * * * *